US011161351B2

(12) United States Patent
Kato et al.

(10) Patent No.: US 11,161,351 B2
(45) Date of Patent: Nov. 2, 2021

(54) LIQUID EJECTION HEAD

(71) Applicant: CANON KABUSHIKI KAISHA, Tokyo (JP)

(72) Inventors: Masataka Kato, Hiratsuka (JP); Takuya Hatsui, Tokyo (JP); Souta Takeuchi, Fujisawa (JP); Masaya Uyama, Kawasaki (JP); Toru Nakakubo, Kawasaki (JP); Tomohiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 218 days.

(21) Appl. No.: 16/573,548

(22) Filed: Sep. 17, 2019

(65) Prior Publication Data

US 2020/0101759 A1 Apr. 2, 2020

(30) Foreign Application Priority Data

Sep. 28, 2018 (JP) ..... JP2018-184617
Aug. 9, 2019 (JP) ..... JP2019-146925

(51) Int. Cl.
*B41J 2/235* (2006.01)
*B41J 2/305* (2006.01)
(Continued)

(52) U.S. Cl.
CPC ..... *B41J 2/235* (2013.01); *B41J 2/03* (2013.01); *B41J 2/14072* (2013.01);
(Continued)

(58) Field of Classification Search
CPC ..... B41J 2/235; B41J 2/1603; B41J 2/14145; B41J 2/14072; B41J 2/03; B41J 2/305;
(Continued)

(56) References Cited

U.S. PATENT DOCUMENTS 4,847,630 A 7/1989 Bhaskar
4,889,587 A 12/1989 Komuro
(Continued)

FOREIGN PATENT DOCUMENTS

CN 1721189 A 1/2006
CN 1721190 A 1/2006
(Continued)

*Primary Examiner* — Henok D Legesse
(74) *Attorney, Agent, or Firm* — Canon U.S.A., Inc. I.P. Division

(57) ABSTRACT

A liquid ejection head is provided with a recording element substrate, and the recording element substrate includes an ejection port member, an electric wiring layer including a pressure generating element array and electric connection portions, and a silicon substrate including the ejection port member and the electric wiring layer on a front surface. The silicon substrate includes a first through hole and a second through hole that protrude the electric connection portions. The rear surface of the silicon substrate is a (100) surface. An extension line of a side extending along the [110] direction, out of sides of the opening of the first trough hole and an extension line of a side extending along the [110] direction, out of sides of the opening of the second through hole are displaced from each other in a direction orthogonal to the [110] direction.

14 Claims, 12 Drawing Sheets

(51) Int. Cl.
*B41J 2/03* (2006.01)
*B41J 2/14* (2006.01)
*B41J 2/16* (2006.01)

(52) U.S. Cl.
CPC ..... *B41J 2/14145* (2013.01); *B41J 2/1603* (2013.01); *B41J 2/305* (2013.01); *B41J 2002/14491* (2013.01); *B41J 2202/18* (2013.01)

(58) Field of Classification Search
CPC ..... B41J 2202/18; B41J 2002/14491; B41J 2/1635; B41J 2/1632; B41J 2/1623; B41J 2/1628; B41J 2202/20; B41J 2/01; B41J 2/14201; B41J 2/1607
See application file for complete search history.

(56) References Cited

U.S. PATENT DOCUMENTS

| | | | | |
|---|---|---|---|---|
| 4,936,952 | A | 6/1990 | Komuro | |
| 9,487,005 | B2 * | 11/2016 | Domae | B41J 2/14201 |
| 2008/0165222 | A1 * | 7/2008 | Hayakawa | B41J 2/1643 347/44 |
| 2011/0059558 | A1 * | 3/2011 | Takeuchi | B41J 2/1603 438/21 |

FOREIGN PATENT DOCUMENTS

| | | | |
|---|---|---|---|
| CN | 1721191 | A | 1/2006 |
| JP | 2000177122 | A | 6/2000 |
| JP | 2006-27109 | A | 2/2006 |

* cited by examiner

FIG.4A1
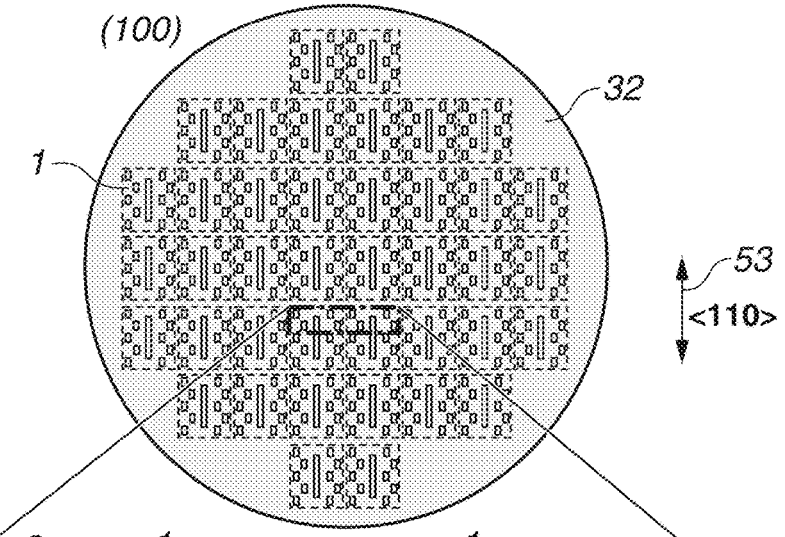
FIG.4A2
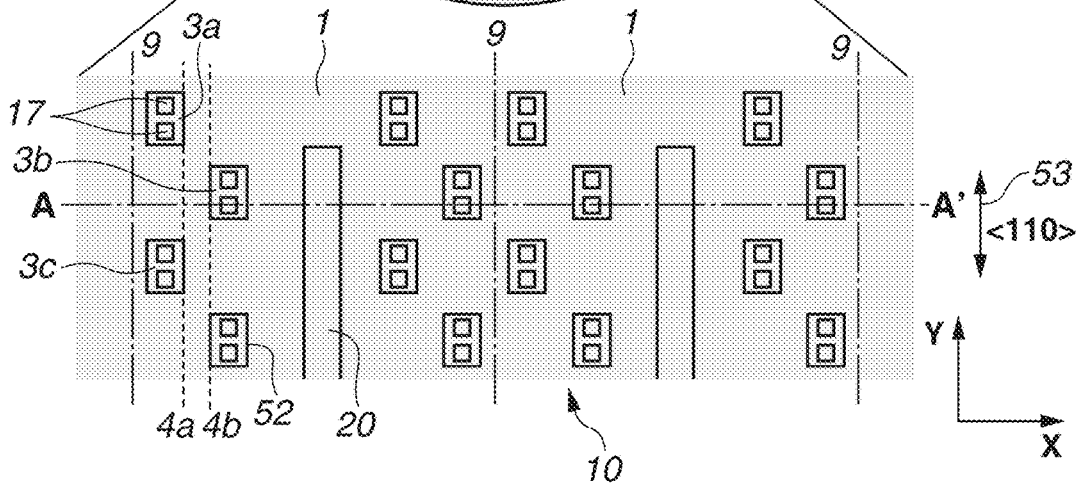
FIG.4B
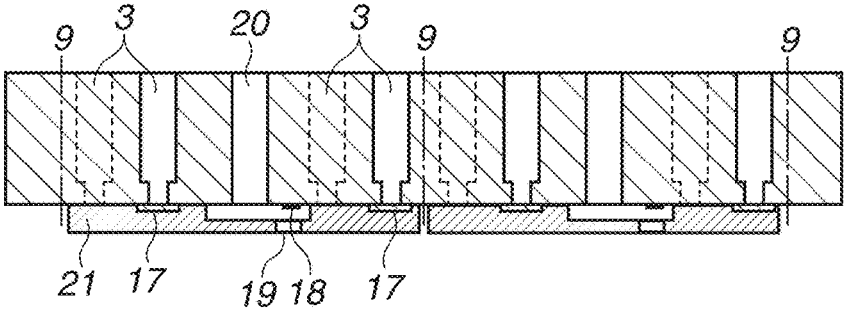
FIG.4C
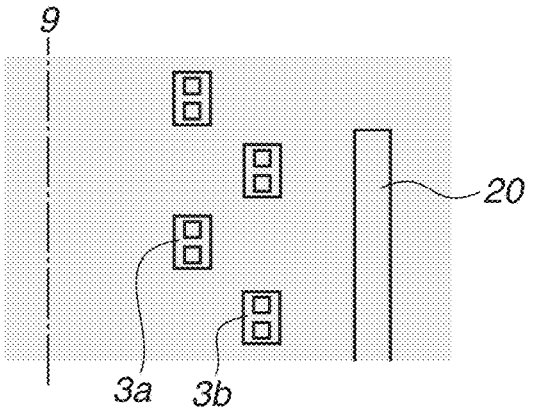

LIQUID EJECTION HEAD

BACKGROUND OF THE INVENTION

Field of the Invention

The present disclosure relates to a liquid ejection head.

Description of the Related Art

An electric connection portion that supplies power from an external power supply to a pressure generating element that pressurizes the liquid is formed on a surface of a recording element substrate provided with an ejection port for ejecting the liquid. When the electric connection portion is formed on the surface provided with the ejection port, however, so-called mist of the liquid, etc. ejected from the ejection port may adhere to the electric connection portion, which may cause corrosion or the like on the electric connection portion.

Therefore, the electric connection portion is desirably separated from an area where the ejection port is provided. Japanese Patent Application Laid-Open No. 2006-27109 discusses a method of providing the electric connection portion on a surface opposite to the surface provided with the ejection port. According to the method, it is necessary to form a plurality of through holes from a surface of a silicon substrate opposite to a surface to be joined to an ejection port member including the ejection port in order to provide the electric connection portion on the surface opposite to the surface provided with the ejection port.

SUMMARY OF THE INVENTION

According to an aspect of the present disclosure, a liquid ejection head is provided with a recording element substrate, and the recording element substrate includes an ejection port member including an ejection port that ejects liquid, an electric wiring layer including a pressure generating element array and electric connection portions, the pressure generating element array including arranged pressure generating elements each pressurizing the liquid for ejection of the liquid, and the electric connection portions being connected to the respective pressure generating elements through electric wirings and supplying power for driving the pressure generating elements to the respective pressure generating elements, and a silicon substrate including the ejection port member and the electric wiring layer on a front surface. The silicon substrate includes a first through hole and a second through hole that penetrate through the silicon substrate, protrude the electric connection portions, and correspond to one line of the pressure generating element array. An opening of the first through hole and an opening of the second through hole are made on a rear surface of the silicon substrate, and the opening of the second through hole is located closest to the opening of the first through hole in a [110] direction of the silicon substrate. The rear surface of the silicon substrate is a (100) surface. An extension line of a side extending along the [110] direction, out of sides of the opening of the first trough hole and an extension line of a side extending along the [110] direction, out of sides of the opening of the second through hole are displaced from each other in a direction orthogonal to the [110] direction.

Further features of the present disclosure will become apparent from the following description of exemplary embodiments with reference to the attached drawings.

BRIEF DESCRIPTION OF THE DRAWINGS

FIG. 4A1 is a diagram illustrating a wafer on which a plurality of recording element substrates is formed, FIG. 4A2 is an enlarged view of a part of the wafer, FIG. 4B is a diagram illustrating a cross-section of the wafer taken along a line A-A' illustrated in FIG. 4A2, and FIG. 4C is a schematic view illustrating a state where a first through hole and a second through hole are disposed in an area between a dicing line and an ink supply port.

DESCRIPTION OF THE EMBODIMENTS

In a case where a silicon substrate is used for a recording element substrate, a silicon substrate including a (100) surface on a front surface is generally adopted. Further, it is known that the silicon substrate including the (100) surface on the front surface is easily broken in a [110] direction. Therefore, in a case where a plurality of through holes formed from a rear surface of the silicon substrate is arranged along the [110] direction, the silicon substrate may be cracked and the recording element substrate may be broken when external force or the like is applied to the silicon substrate.

The present disclosure is made in consideration of the above-described situations and is directed to a liquid ejection head that can suppress breakage of the recording element substrate in which the plurality of through holes are formed from the rear surface.

A liquid ejection head and a method of manufacturing the liquid ejection head according to exemplary embodiments of the present disclosure are described below with reference to drawings. Note that the following description does not limit the range of the present disclosure. In the present exemplary embodiments, a thermal system in which a heating element generates air bubbles and liquid is ejected is adopted as the liquid ejection head as an example; however, the present disclosure is applicable also to a liquid ejection head adopting a piezoelectric system or other various kinds of liquid ejection systems. Further, as the liquid ejection head according to the present exemplary embodiments, a so-called page-wide head that has a length corresponding to a width of a recording medium is illustrated; however, the present disclosure is also applicable to a so-called serial liquid ejection head that performs recording while performing scanning on the recording medium. Examples of a configuration of the serial liquid ejection head include a configuration on which one recording element substrate for black ink and one recording element substrate for color ink are mounted.

(Liquid Ejection Head)

Figure 1:
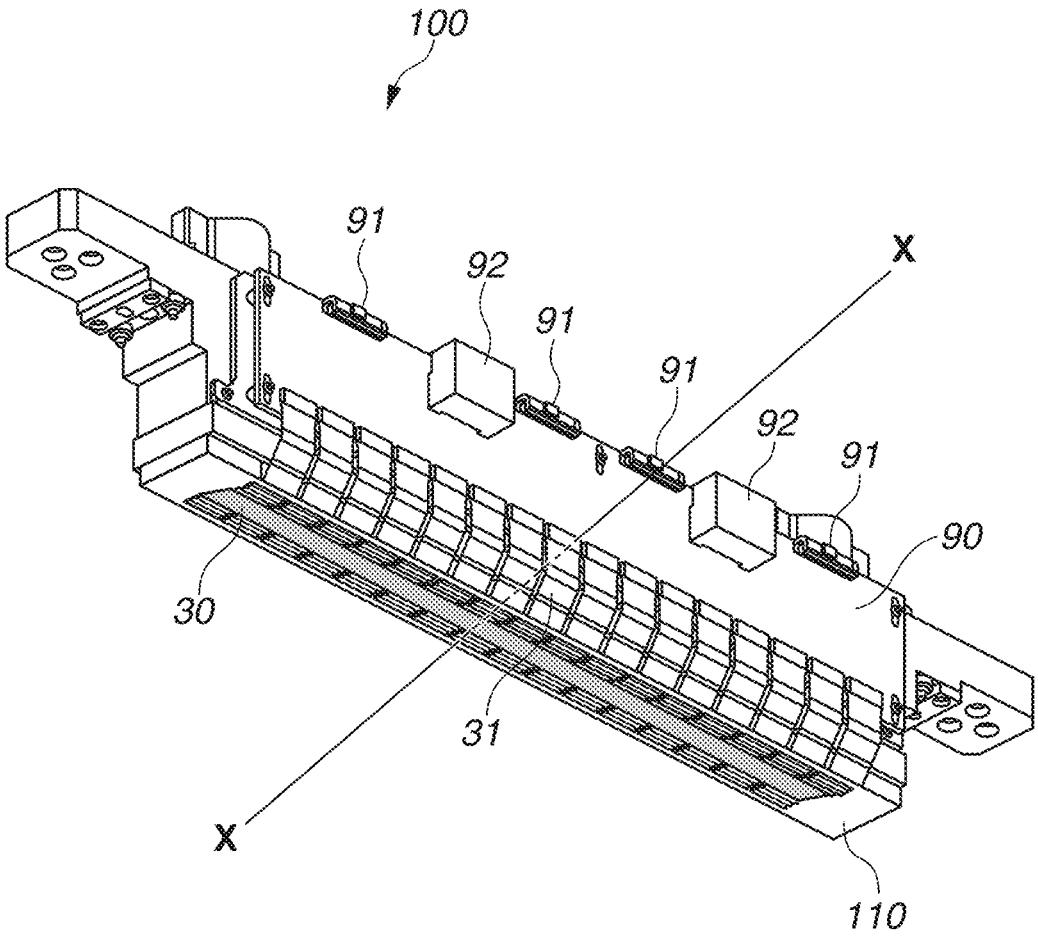
FIG. 1 is a perspective view illustrating a liquid ejection head.

A first exemplary embodiment is described below. A liquid ejection head according to the present exemplary embodiment is described with reference to FIG. 1. FIG. 1 is a perspective view illustrating a liquid ejection head 100 according to the present exemplary embodiment. The liquid ejection head 100 according to the present exemplary embodiment is a page-wide liquid ejection head that can eject ink of four colors C/M/Y/K and includes 16 recording element substrates 30 which are linearly arranged (arranged in-line). The liquid ejection head 100 includes the recording element substrates 30, flexible electric wiring members 31, a plate-like electric wiring substrate 90, signal input terminals 91, and power supply terminals 92. The signal input terminals 91 and the power supply terminals 92 are electrically connected to a control unit of a recording apparatus body (not illustrated) that includes a conveyance unit (not illustrated) for conveying a recording medium (not illustrated) and the liquid ejection head 100. Further, the signal input terminals 91 and the power supply terminals 92 supply ejection driving signals and power necessary for ejection to the recording element substrates 30 through the electric wiring members 31. Each of the electric wiring members 31 is, for example, a flexible printed circuit (FPC). The wirings converge into an electric circuit of the electric wiring substrate 90, which makes it possible to decrease the installation number of signal input terminals 91 and the installation number of power supply terminals 92 as compared with the number of recording element substrates 30. As a result, it is possible to reduce the number of electric connection portions to be attached/detached when the liquid ejection head 100 is attached/detached to/from the recording apparatus body.

Although FIG. 1 illustrates the page-wide liquid ejection head in which the recording element substrates 30 are linearly arranged in a longitudinal direction of the liquid ejection head, the present exemplary embodiment is not limited thereto. The page-wide liquid ejection head may also be the recording element substrates 30 which are arranged in a staggered manner in the longitudinal direction.

(Recording Element Substrate)

Figure 2A:
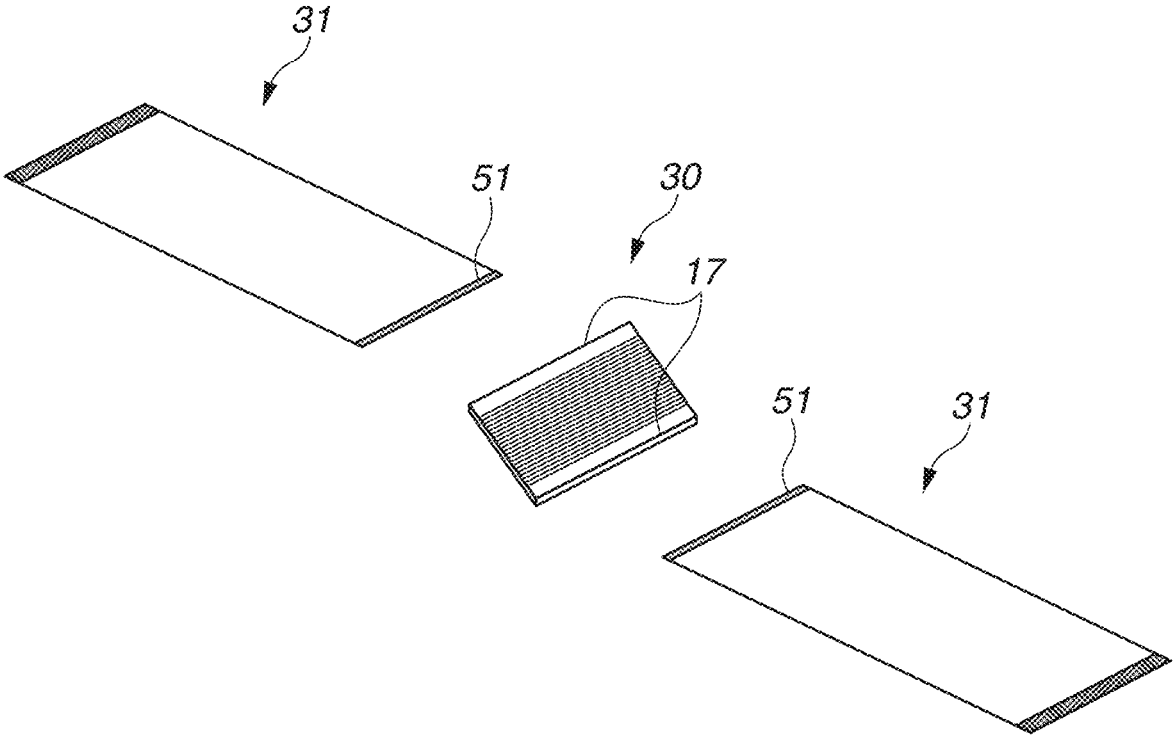
FIG. 2A is a perspective view illustrating a state before a recording element substrate and electric wiring members are electrically connected.
Figure 2B:
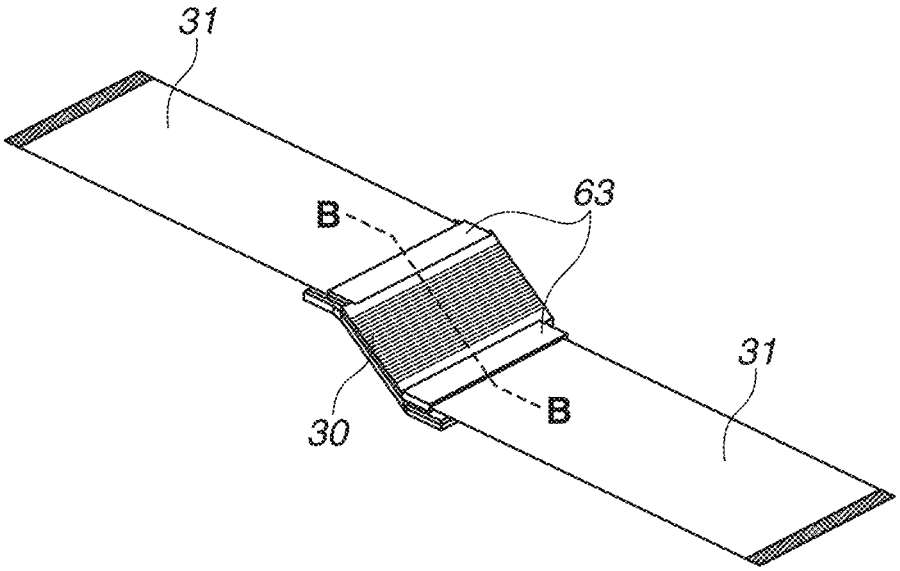
FIG. 2B is a perspective view illustrating a state where the recording element substrate and the electric wiring members are electrically connected.

The recording element substrates that are the feature of the present exemplary embodiment are described with reference to FIG. 2A to FIG. 4C. First, electric connection between the recording element substrates 30 and the electric wiring members 31 is described with reference to FIGS. 2A and 2B. FIGS. 2A and 2B are perspective views each illustrating one recording element substrate 30 and corresponding electric wiring members 31, out of the plurality of recording element substrates 30 and the plurality of electric wiring members 31 provided on the liquid ejection head 100, and illustrate a rear surface opposite to a surface provided with an ejection port of the recording element substrate 30 (hereinafter, simply referred to as rear surface). FIG. 2A is a perspective view illustrating a state before the recording element substrate 30 and the electric wiring members 31 are electrically connected, and Ft. 2B is a perspective view illustrating a state where the recording element substrate 30 and the electric wiring members 31 are electrically connected.

Figure 3:
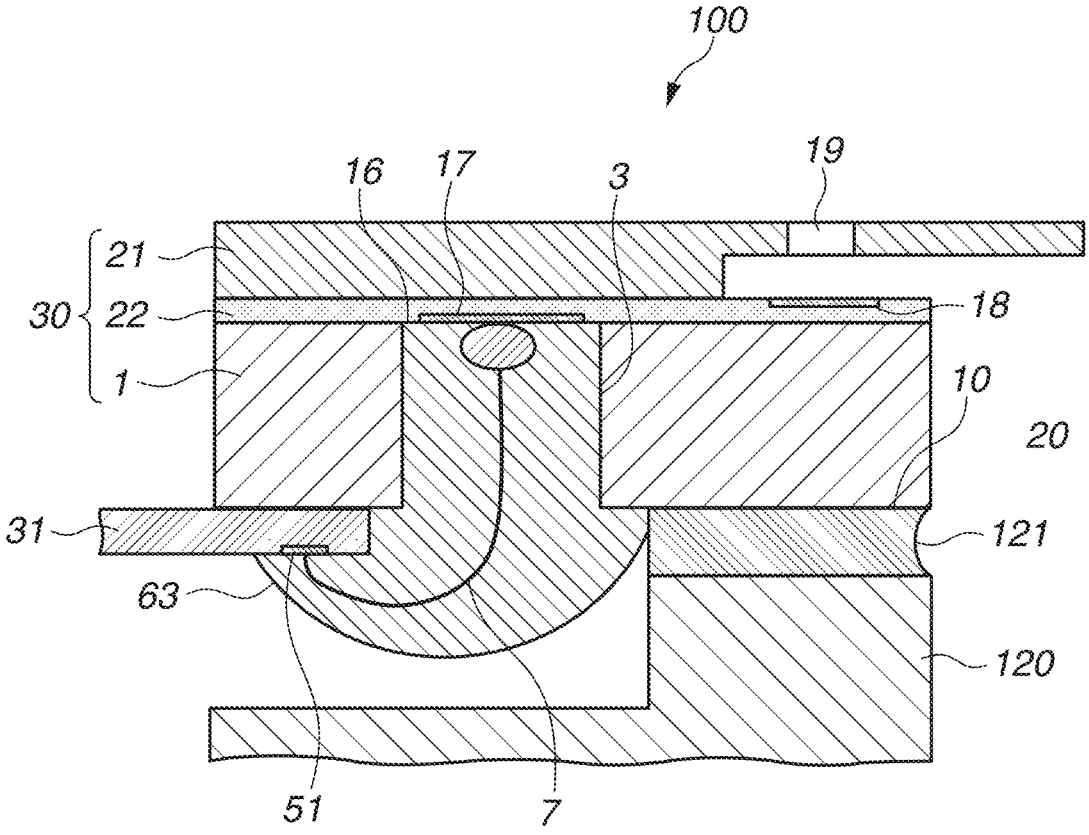
FIG. 3 is a schematic view illustrating a configuration of electric connection.

In the present exemplary embodiment, as illustrated in FIG. 2B, electric connection portions 17 provided on the rear surface of the recording element substrate 30 and a terminal 51 of the electric wiring members 31 are electrically connected by metal wires 7 (FIG. 3). Further, each of electric connection places are covered with a sealing member 63, and a part of the sealing member 63 fills in each of through holes 3 (FIG. 3). In the present exemplary embodiment, a state where the recording element substrate 30 and the electric wiring members 31 are connected as illustrated in FIG. 2B is handled as one module, and 16 modules in total are arranged to configure the page-wide liquid ejection head. When such a module is configured in such a manner and the number of modules to be mounted is appropriately changed, it is possible to provide the liquid ejection head having a necessary length.

Next, the configuration of one recording element substrates 30 is described in detail with reference to FIG. 3. FIG. 3 is a schematic view illustrating a part of a cross-section taken along a line B-B in FIG. 2B. Although a flow path member 120 is not illustrated in FIG. 2B, the flow path member 120 is illustrated in FIG. 3 for a description purpose. The electric wiring member 31 is placed on a rear surface of a silicon substrate 1, and the terminal 51 of the electric wiring member 31 and the electric connection portions 17 of the recording element substrate 30 are electrically connected through so-called wire bonding. The recording element substrate 30 is in tight contact with the flow path member 120 through a sealing member 121. Ink is supplied to an ejection port 19 from an ink supply port 20 formed by the flow path member 120.

As illustrated in FIG. 3, the recording element substrate 30 includes the silicon substrate 1, an electric wiring 22, and an ejection port member 21. The ink supply port 20 is provided in the recording element substrate 30. The ink supplied from the ink supply port 20 is pressurized by a pressure generating element 18, and the pressurized ink is ejected from the ejection port 19. The plurality of pressure generating elements 18 is arranged along a [110] direction of the silicon substrate described below, to configure a pressure generating element array. In the present exemplary embodiment, the pressure generating element 18 is a heater generating thermal energy, and generates air bubbles in the ink by heating to eject the ink with bubbling pressure of the air bubbles. The pressure generating element 18 is electrically connected to the corresponding electric connection portion 17 through the electric wiring 22. Power to drive the pressure generating element 18 is supplied to the pressure generating element 18 by connecting the electric connection portion 17 to an outside of the recording element substrate 30. The through holes 3 are formed by a so-called dry etching and provided on the rear surface of the silicon substrate 1. The electric connection portions 17 are located on bottom parts 16 of the respective through holes 3. Therefore, the through holes 3 protrudes the electric connection portions 17. Further, an electric wiring layer is configured of the pressure generating element array and the electric connection portions 17. As illustrated in FIG. 3, the silicon substrate 1 includes the ejection port member 21 and the electric wiring layer on a front surface.

The shape of each of the through holes 3 in the recording element substrate 30 (FIGS. 4A to 4C) described below and the shape of each of the through holes 3 in FIG. 3 are different from each other; however, the present exemplary embodiment is applicable to both shapes. Only for convenience of description, FIG. 3 illustrates the recording element substrate 30 more simply than the recording element substrate 30 in FIGS. 4A to 4C.

Next, positions forming the through holes 3 in the recording element substrate 30 are described with reference to FIGS. 4A1 to 4C. FIG. 4A1 is a diagram illustrating a wafer on which the plurality of recording element substrates 30 is formed, and FIG. 4A2 is an enlarged view of a part of the wafer. FIG. 4B is a diagram illustrating a cross-section of the wafer taken along a line A-A' in FIG. 4A2. Since the wafer 32 having a (100) surface on a front surface is used, the rear surface of the silicon substrate 100 becomes the (100) surface. The silicon substrate including the (100) surface on the front surface is easily broken in a direction of a mirror index of [110] illustrated by an arrow 53. As illustrated in FIG. 4A2, the shape of each of the through holes 3 in the present exemplary embodiment is a rectangular shape having a side substantially orthogonal to the [110] direction. Further, as illustrated in FIG. 4A2, there are a first through hole 3*a* that is provided near a line 9 for dicing of the wafer, and a second through hole 3*b* that is provided at a position separated from the line 9 by about a length of one through hole 3 relative to the first through hole 3*a*. The first through hole 3*a* and the second through hole 3*b* are provided on the silicon substrate 1 on left side on a sheet of the ink supply port 20 which serves as a boundary. In other words, the first through hole 3*a* and the second through hole 3*b* correspond to one pressure generating element array that includes the plurality of pressure generating elements 18 arranged in a Y direction. Further, as illustrated in FIGS. 4A to 4C, the second through hole 3*b* is located closest to the first through hole 3*a* in the [110] direction.

An extension line 4*a* is extended from a side extending along the [110] direction out of sides of an opening 52 of the first through hole 3*a* provided on the rear surface of the silicon substrate 1. Likewise, an extension line 4*b* is extended from a side extending along the [110] direction of the second through hole 3*b*. At this time, the first through hole 3*a* and the second through hole 3*b* are disposed such that the extension line 4*a* and the extension line 4*b* are displaced from each other in a direction (X direction) orthogonal to the [110] direction. Although the first through hole 3*a* includes two sides extending along the [110] direction, FIG. 4A2 illustrates only the extension line 4*a* on the side close to the second through hole 3*b*. Likewise, FIG. 4A2 illustrates the extension line 4*b* of the second through hole 3*b* on the side close to the first through hole 3*a*. In the present exemplary embodiment, the first through hole 3*a* and the second through hole 3*b* are disposed such that, out of the sides of the opening in each of the first through hole 3*a* and the second through hole 3*b*, extension lines of all of the sides extending along the [110] direction are displaced from one another in the direction (X direction) orthogonal to the [110] direction. When the first through hole 3*a* and the second through hole 3*b* are disposed in the above-described manner, a through hole that has a side coincident with the side extending in the [110] direction of the first through hole 3*a* and is located closest to the first through hole 3*a* in the [110] direction, is a third through hole 3*c*. As a result, an arranged interval between the first through hole 3*a*, and the through hole that is located closest to the first through hole 3*a* and has a side coincident with the extension of the side extending in the [110] direction of the first through hole 3*a*, is increased. Thus, rigidity of the silicon substrate is improved. Accordingly, it is possible to prevent the silicon substrate 1 from breaking in the [110] direction when external force or the like is applied.

Further, according to the present exemplary embodiment, it is possible to prevent the silicon substrate 1 from breaking also at the time of dicing the wafer 32. This is because the first through hole 3*a* disposed relatively close to the line 9 and the second through hole 3*b* disposed relatively far from the line 9 are alternately disposed, so that rigidity of the wafer 32 near the line 9 increases.

Figure 11A:
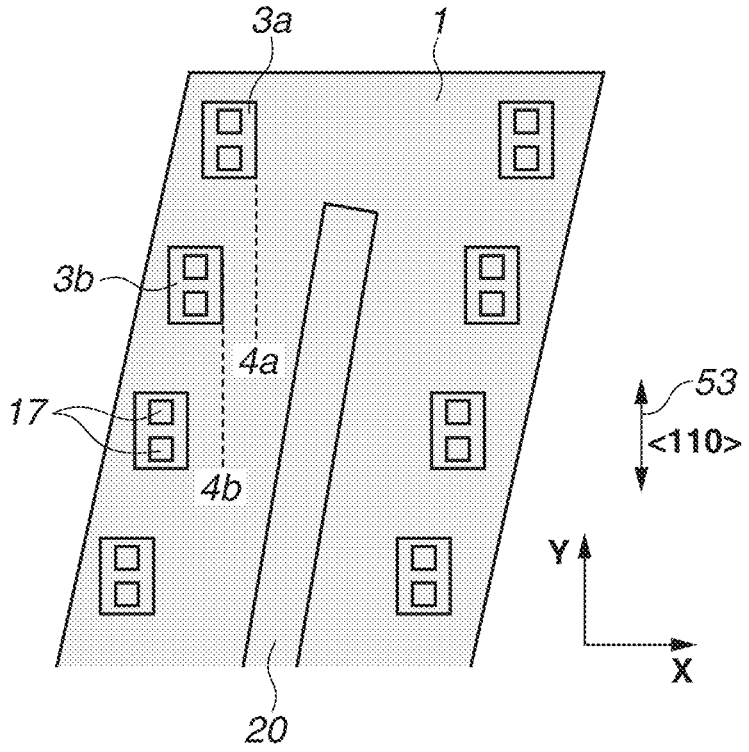
FIG. 11A is a schematic view illustrating a case where through holes are provided along a long side of a silicon substrate.
Figure 11B:
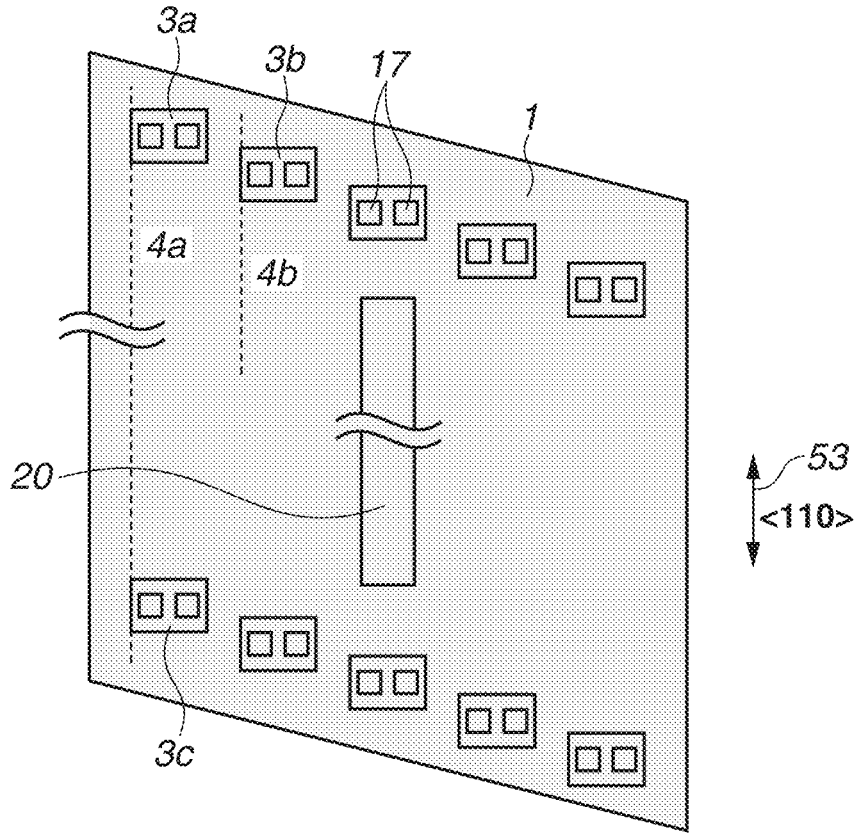
FIG. 11B is a schematic view illustrating a case where through holes are provided along a short side of the silicon substrate.

While the first through hole 3*a* and the second through hole 3*b* are arranged along the dicing line 9, namely, along an end part of the recording element substrate 30 in FIGS. 4A1 and 4A2, the arrangement of the present exemplary embodiment is not limited thereto. Alternatively; for example; the first through hole 3*a* and the second through hole 3*b* may be arranged in an area between the dicing line 9 and the ink supply port 20 (FIG. 4C). Also in this case, effects similar to the silicon substrate 1 illustrated in FIGS. 4A1 and 4A2 are achievable. Further; the silicon substrate 1 having a rectangular outer shape as illustrated in FIG. 4A1 has been described above; however, the silicon substrate 1 having a parallelogram outer shape as illustrated in FIGS. 11A and 11B may be used.

Comparative Example

Figure 12:
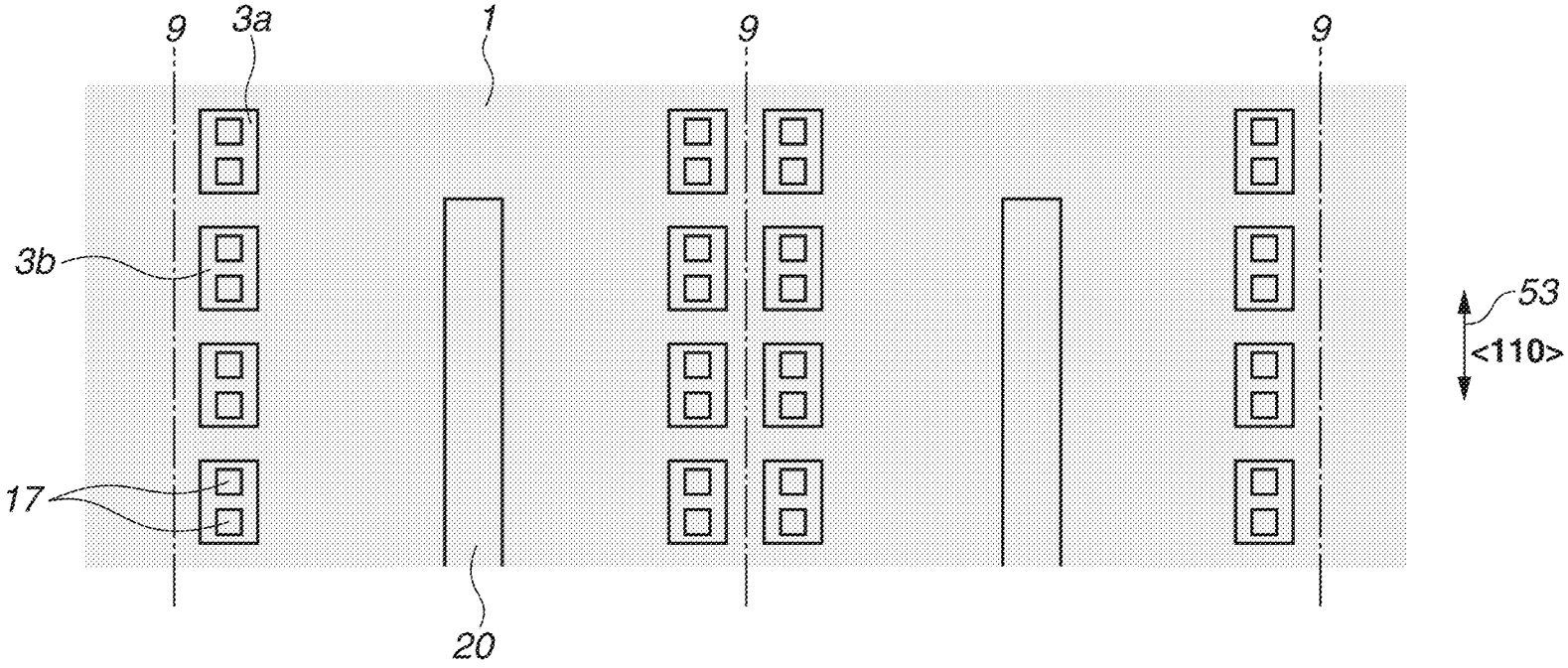
FIG. 12 is a schematic view illustrating a silicon substrate according to a comparative example.

An example comparable to the present exemplary embodiment is described with reference to FIG. 12. FIG. 12 is a schematic view illustrating a silicon substrate according to the comparative example. The silicon substrate 1 according to the comparative example is different from the silicon substrate 1 according to the above-described exemplary embodiment in that the extension line of the side extending in the [110] direction of the first through hole 3*a* and the extension line of the side extending in the [110] direction of the second through hole 3*b* are coincident with each other. Accordingly, the arranging interval between the first through hole 3*a* and the through hole that is located closest to the first through hole 3*a* and has a side coincident with the extension line of the side extending in the [110] direction of the first through hole 3*a*, becomes small, which reduces the rigidity of the silicon substrate 1. As a result, the silicon substrate 1 is easily broken in the [110] direction.

In contrast, when the first through hole 3*a* and the second through hole 3*b* are disposed as described in the exemplary embodiment, the through hole located on the extension line of the side extending in the [110] direction of the first through hole 3*a* becomes the third through hole 3*c*, and the arranging interval of the through holes is increased. Thus, the rigidity of the silicon substrate 1 can be improved, and the silicon substrate 1 is prevented from breaking in the [110] direction when external force or the like is applied.

(Method of Manufacturing Liquid Ejection Head)

Figure 5:
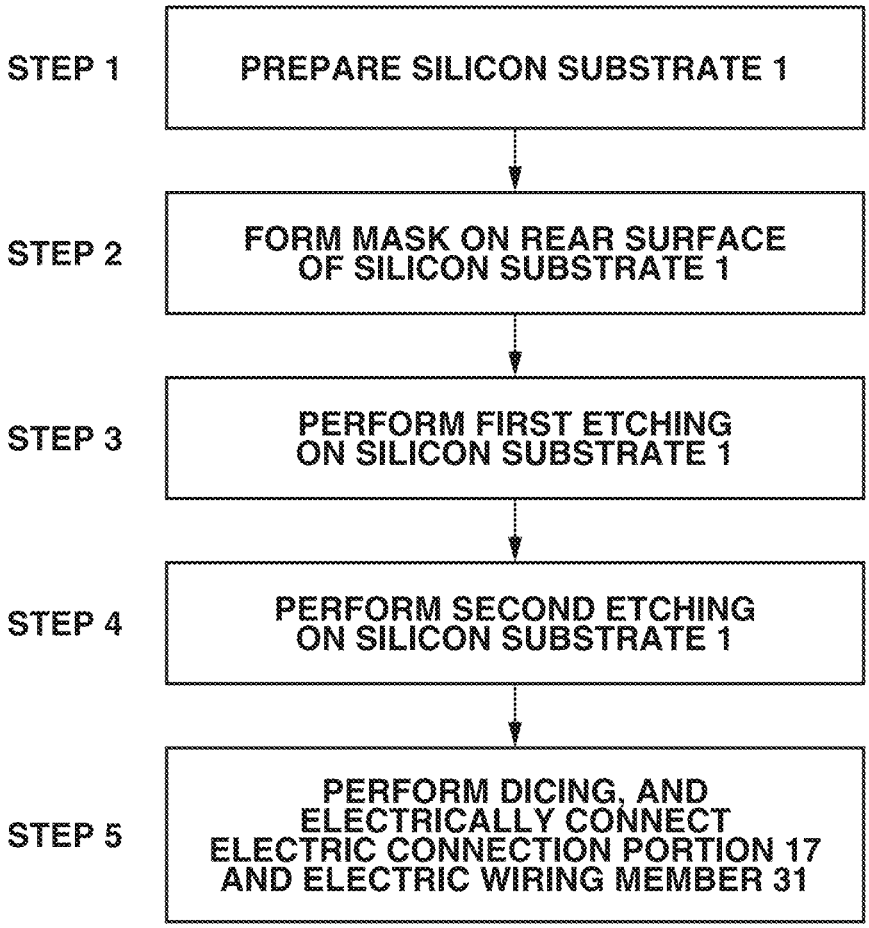
FIG. 5 is a flowchart illustrating manufacturing steps of the liquid ejection head.
Figure 6A:
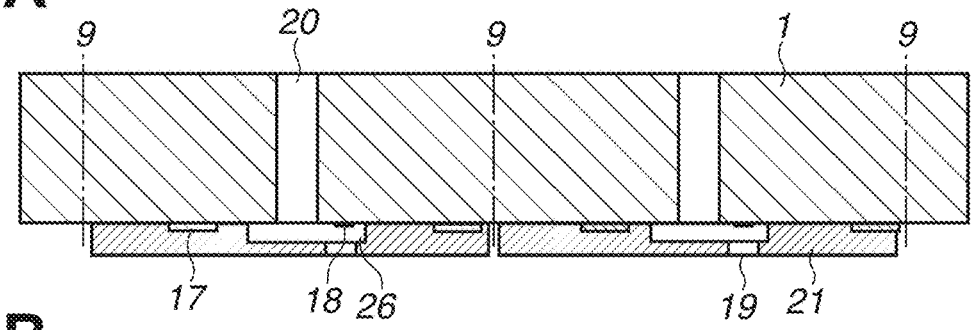
FIG. 6A is a schematic view illustrating step S1 in FIG. 5.
Figure 6B:
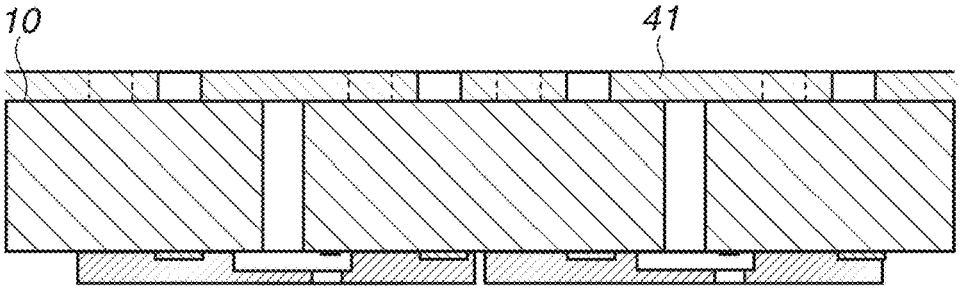
FIG. 6B is a schematic view illustrating step S2 in FIG. 5.
Figure 6C:
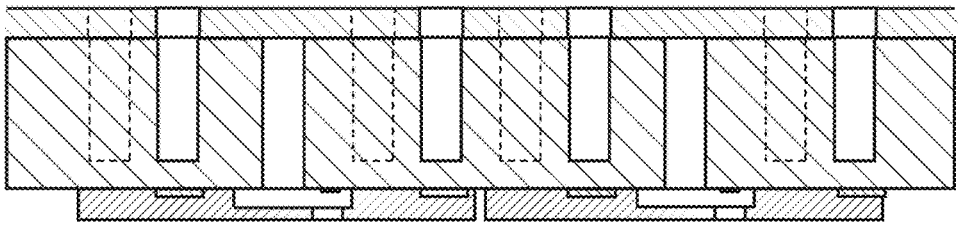
FIG. 6C is a schematic view illustrating step S3 in FIG. 5.
Figure 6D:
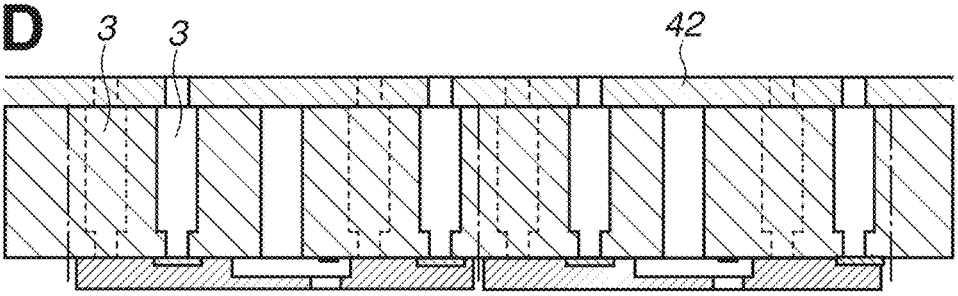
FIG. 6D is a schematic view illustrating step S4 in FIG. 5.
Figure 6E:
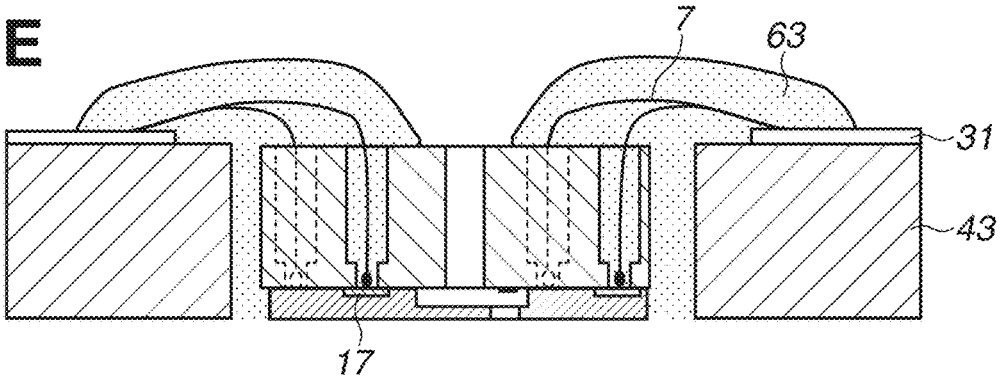
FIG. 6E is a schematic view illustrating step S5 in FIG. 5.

A method for manufacturing the liquid ejection head according to the present exemplary embodiment is described with reference to FIG. 5 and FIGS. 6A to 6E. FIG. 5 is a flowchart illustrating manufacturing steps. FIGS. 6A to 6E are schematic views illustrating the cross-section of the recording element substrate 30 taken along a line A-A' illustrated in FIG. 4A2 and corresponding to the respective manufacturing steps in FIG. 5.

First, in step S1 (FIG. 5 and FIG. 6A), the silicon substrate 1 provided with the ejection port member 21, etc. is prepared. Next, in step S2 (FIG. 5 and FIG. 6B), a mask is formed on a rear surface 10 of the silicon substrate 1 through patterning using a tenting resist 41. Next, in step S3 (FIG. 5 and FIG. 6C), a hole for electric connection is formed through reactive ion etching (RIE) with use of the tenting resist 41 as the mask. At this time, the hole may penetrate through the silicon substrate 1, or may be formed in a two-stepped shape with use of a tenting resist 42 described below.

Next, in step S4 (FIG. 5 and FIG. 6D), the tenting resist 41 is removed, and then the tenting resist 42 that includes an opening smaller than the opening of the tenting resist 41 is formed on the rear surface 10 of the silicon substrate 1. The RIE using the tenting resist 42 as a mask is performed on the silicon substrate 1 to form the two-stepped through holes 3. Further, an insulation layer (not illustrated) on the electric connection electrodes (electric connection portions) 17 is removed with use of the mask, to expose the electric connection portions 17.

Next, in step S5 (FIG. 5 and FIG. 6E), the silicon substrate 1 is diced along the dicing line 9 into individual chips. Thereafter, the electric wiring member 31 formed on a mounting member 43 and the corresponding electric connection portion 17 formed on the rear surface are electrically connected by a wire-binding method with use of a flexible wire such as a gold (Au) wire 7. Thereafter, the inside of each of the through holes 3 is filled with the sealing member 63 covering the electric connection place. The position of the electric wiring member 31 in FIG. 6E and the position of the electric wiring member 31 in FIG. 3 are different from each other; however, the present exemplary embodiment can adopt any of the positions, and the position is not limited to one of these positions.

Figure 7A:
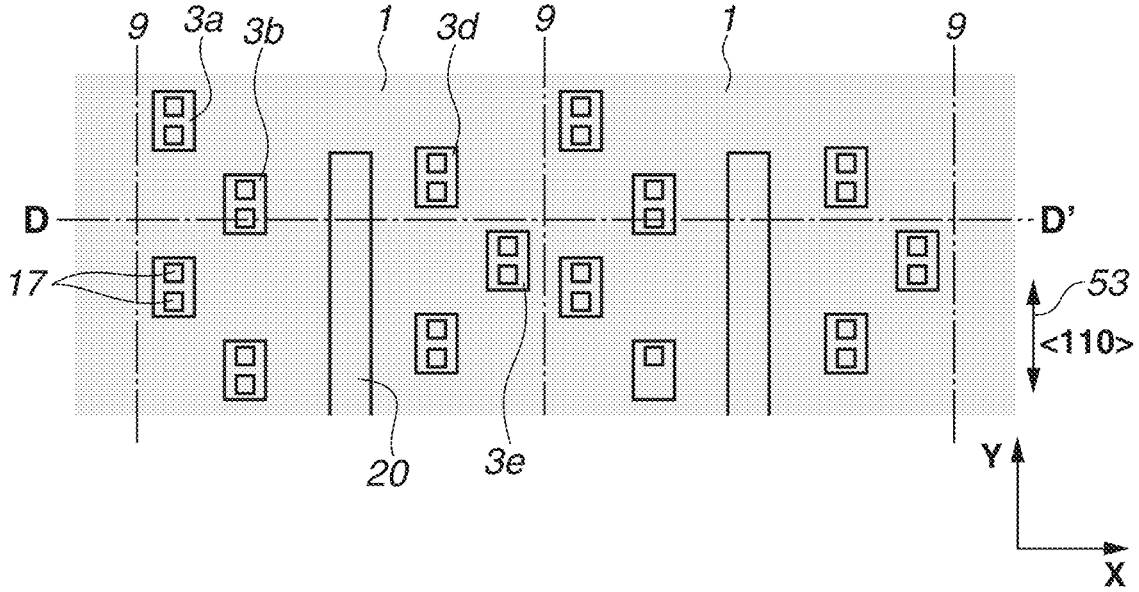
FIG. 7A is a top view illustrating a rear surface of a silicon substrate according to a second exemplary embodiment.
Figure 7B:
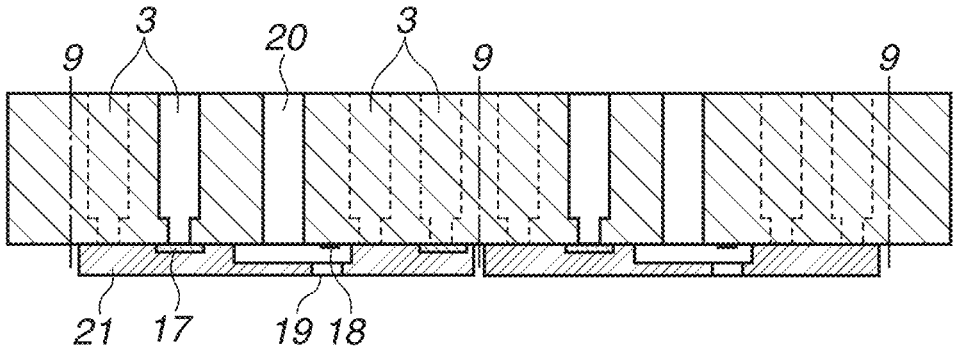
FIG. 7B is a schematic view illustrating a cross-section of the silicon substrate taken along a line D-D' in FIG. 7A.
Figure 7C:
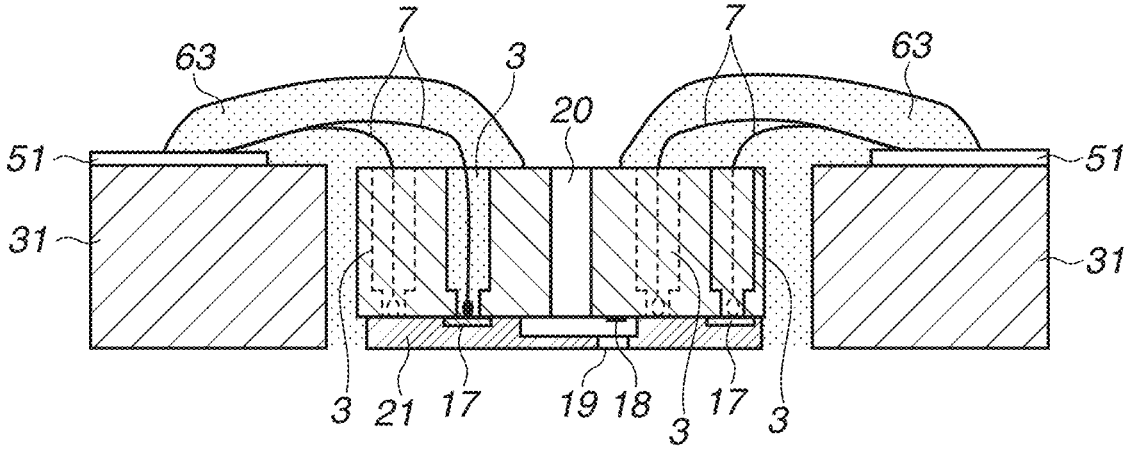
FIG. 7C is a schematic view illustrating a state where a recording element substrate and an electric wiring member are electrically connected.

A second exemplary embodiment according to the present disclosure is described with reference to FIGS. 7A to 7C. Components similar to the components according to the first exemplary embodiment are denoted by the same reference numerals, and description thereof is omitted. FIGS. 7A to 7C are diagrams illustrating the silicon substrate 1 according to the second exemplary embodiment. FIG. 7A is a top view illustrating the rear surface of the silicon substrate 1, FIG. 7B is a schematic view illustrating a cross-section taken along a line D-D' illustrated in FIG. 7A, and FIG. 7C is a schematic view illustrating a state where the recording element substrate 30 and the electric wiring member 31 are electrically connected.

The present exemplary embodiment is different from the first exemplary embodiment in that a through hole 3*d* and a through hole 3*e* are provided at positions asymmetric to the first through hole 3*a* and the second through hole 3*b* with the ink supply, port 20 as a symmetry axis. It is known that the silicon substrate is easily broken also in the X direction orthogonal to the [110] direction. Therefore, through arrangement of the through holes 3 as described in the present exemplary embodiment, the rigidity of the silicon substrate 1 can be increased also in the X direction orthogonal to the [110] direction. Thus, the silicon substrate 1 can be prevented from breaking in the X direction. In other words, in the present exemplary embodiment, it is possible to prevent breakage of the silicon substrate 1 in the X direction while preventing breakage of the silicon substrate 1 in the [110] direction.

A third exemplary embodiment according to the present disclosure is described with reference to FIGS. 8A and 8B. Components similar to the components according to the first exemplary embodiment are denoted by the same reference numerals, and description thereof is omitted. The feature of the present exemplary embodiment is a cover member 110 that is attached on the side provided with the ejection port 19 of the liquid ejection head 100.

Figure 8A:
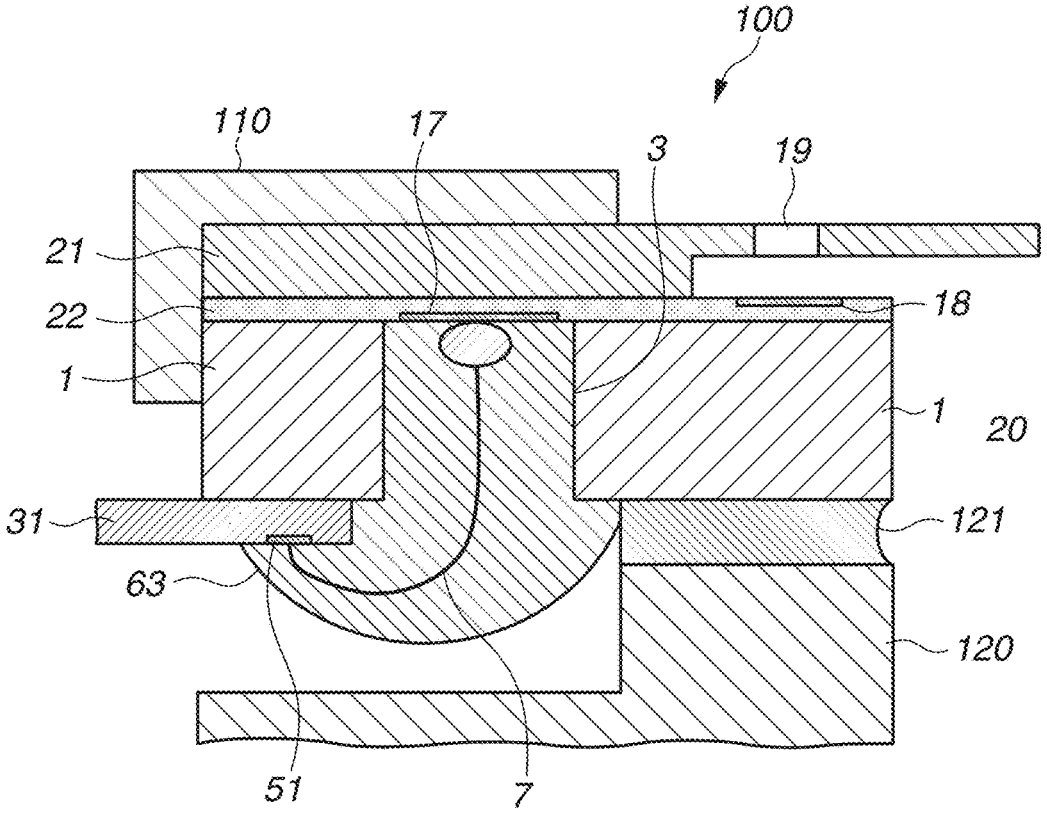
FIG. 8A is a schematic view illustrating a part of a cross-section of the recording element substrate taken along a line B-B illustrated in FIG. 2B.
Figure 8B:
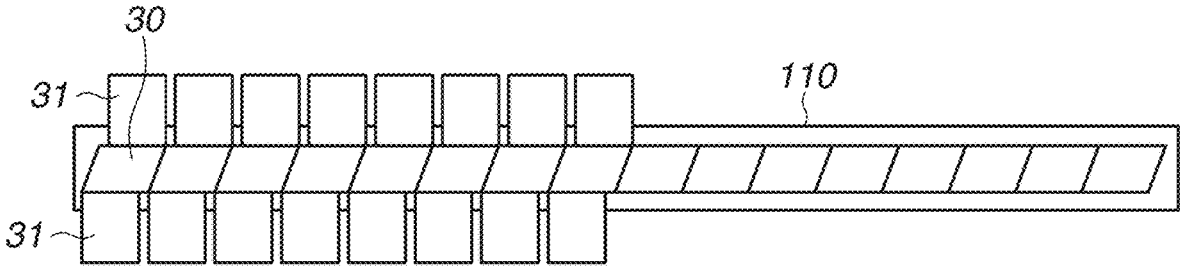
FIG. 8*b* is a schematic view illustrating a plurality of recording element substrates attached to a cover member, and the cover member as viewed from rear surface side of the recording element substrates.

FIG. 8A is a schematic view illustrating a part of the cross-section of the recording element substrate 30 taken along a line B-B illustrated in FIG. 2B. FIG. 8B is a schematic view illustrating a plurality of recording element substrates 30 attached to the cover member 110, and the cover member 110 as viewed from the rear surface side of the recording element substrates 30. As illustrated in FIG. 8B, the cover member 110 has a frame shape including an opening to expose the recording element substrates 30, and an inner surface of the frame and the recording element substrates 30 are fixed with an adhesive (not illustrated).

Since the through holes 3 are provided on the rear surface of each of the recording element substrates 30, the substrate at that part is reduced in thickness and strength, which may cause deformation and breakage of the substrate. In the present exemplary embodiment, the cover member 110 is provided corresponding to the positions where the through holes 3 are provided. In other words, the through holes 3 and the frame of the cover member 110 are located so as to overlap with each other as viewed from the ejection port surface. Therefore, the present exemplary embodiment is preferable in terms of improvement in strength of the part of the recording element substrates 30 where the through holes 3 are provided. As a material of the cover member 110, various kinds of materials such as a resin and a metal are usable, and a metal such as steel use stainless (SUS) is preferable in terms of strength. Further, a resin is usable; however, a resin containing filler is preferably used in terms of strength.

Other Embodiments

Figure 9:
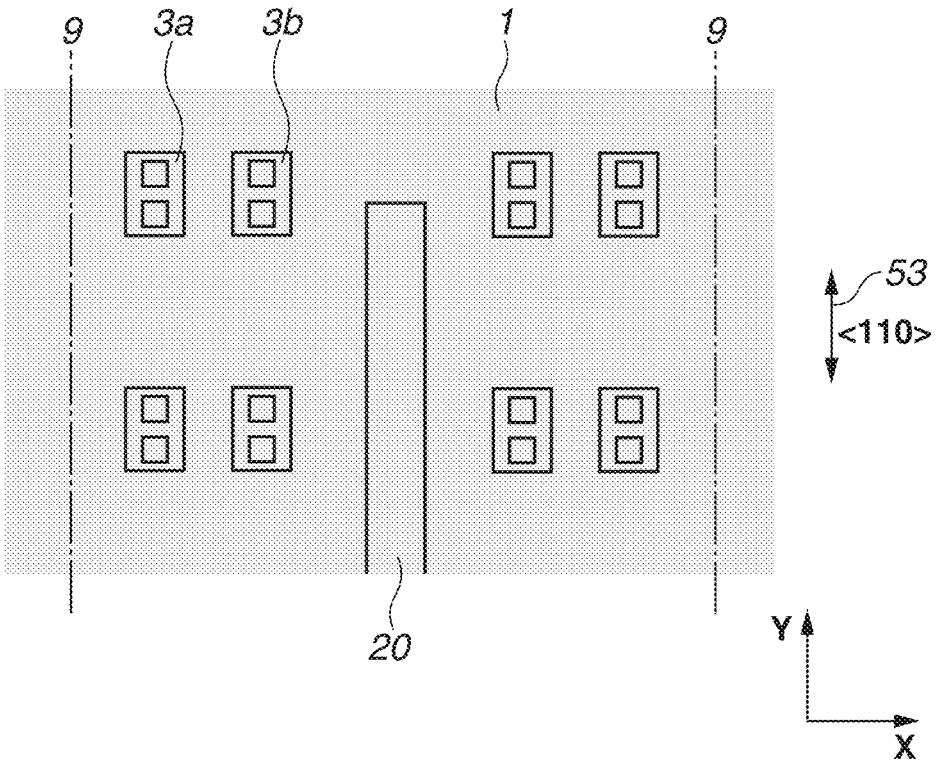
FIG. 9 is a schematic view illustrating a silicon substrate according to another exemplary embodiment.

Other exemplary embodiments according to the present disclosure are described with reference to FIG. 9 to FIG. 11B. Components similar to the first exemplary embodiment are denoted by the same reference numerals, and description thereof is omitted. FIG. 9 to FIG. 11B each illustrate a modification of the arrangement of the through holes 3 in a silicon substrate having effects similar to the effects achieved by the first exemplary embodiment. FIG. 9 is a schematic view illustrating the silicon substrate 1 in which the first through hole 3*a* and the second through hole 3*b* arranged in parallel in the X direction are arranged along the [110] direction. In other words, the second through hole 3*b* is disposed on a bisector (not illustrated) of the side extending in the [110] direction of the first through hole 3*a*. This increases the arrangement interval between the first through hole 3*a* and a through hole that is located closest to the first through hole 3*a* and has a side coincident with the extension line of the side extending in the [110] direction of the first through hole 3*a*. As a result, the rigidity of the silicon substrate 1 is improved, thus breakage of the silicon substrate 1 can be prevented.

Figure 10:
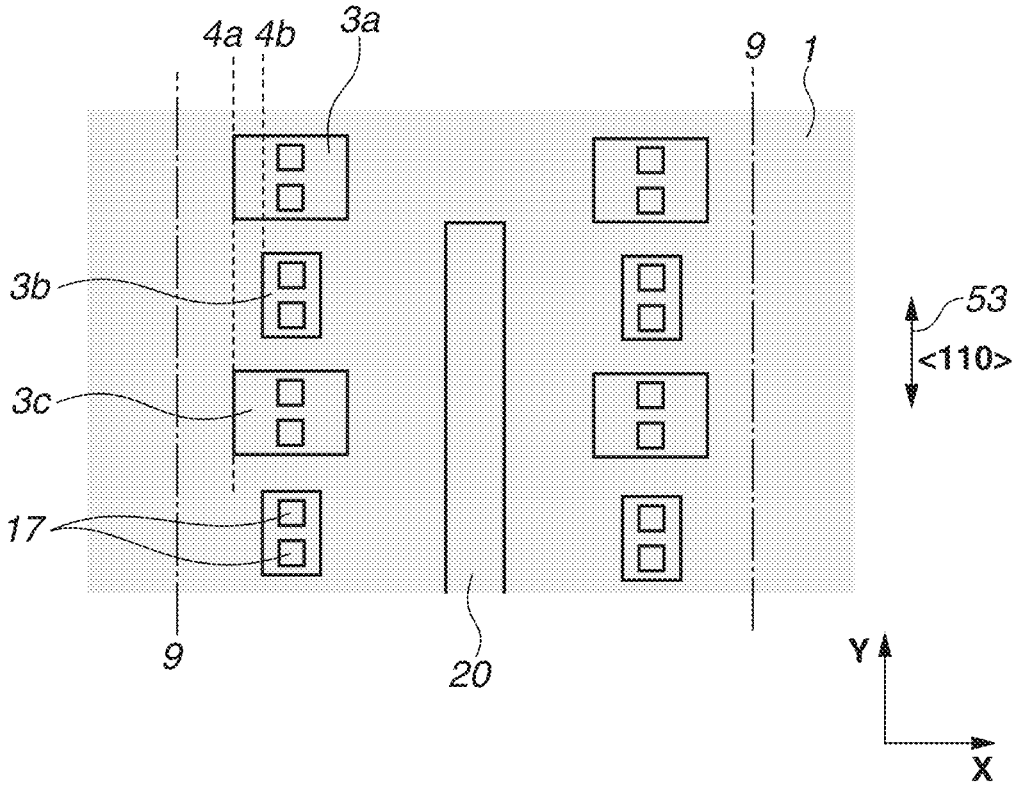
FIG. 10 is a schematic view illustrating a silicon substrate according to still another exemplary embodiment.

FIG. 10 is a schematic view illustrating the silicon substrate 1 provided with the first through hole 3*a*. The side of the first through hole 3*a* extending in the X direction is larger than the side extending in the X direction of the second through hole 3*b*. In FIG. 10, the through holes are arranged such that a bisector (not illustrated) of a side intersecting the [110] direction of the first through hole 3*a* and a bisector (not illustrated) of a side intersecting the [110] direction of the second through hole 3*b* are overlapping with each other. Also in FIG. 10, the extension line 4*a* of the side extending in the [110] direction of the first through hole 3*a* and the extension line 4*b* of the side extending in the [110] direction of the second through hole 3*b* are displaced from each other in the X direction as illustrated in FIGS. 4A1 to 4C illustrated in the first exemplary embodiment. Accordingly, the through hole that is located closest to the first through hole 3*a* and has the side coincident with the extension line of the side extending in the [110] direction of the first through hole 3*a* is the third through hole 3*c*, and the arranging interval between the through holes is increased. This improves the rigidity of the silicon substrate 1, so that the silicon substrate 1 can be prevented from breaking in the [110] direction when external force or the like is applied.

FIGS. 11A and 11B are schematic views each illustrating a state where the through holes are provided on the silicon substrate 1 having a parallelogram. FIG. 11A illustrates a case where the through holes are provided along a long side of the silicon substrate 1, and FIG. 11B illustrates a case where the through holes are provided along a short side of the silicon substrate 1. Also in FIGS. 11A and 11B, the extension line 4*a* of the side extending in the [110] direction of the first through hole 3*a* and the extension line 4*b* of the side extending in the [110] direction of the second through hole 3*b* are displaced from each other in the X direction as illustrated in FIGS. 4A1 to 4C as with the first exemplary embodiment. Accordingly, the through hole that is located closest to the first through hole 3*a* and has the side coincident with the extension line of the side extending in the [110] direction of the first through hole 3*a* is the third through hole 3*c*, and the arranging interval between the through holes is increased. Thus, the rigidity of the silicon substrate 1 can be improved, and the silicon substrate 1 can be prevented from breaking in the [110] direction when external force or the like is applied.

According to the exemplary embodiments of the present disclosure, it is possible to provide the liquid ejection head that can prevent breakage of the recording element substrate in which the plurality of through holes are formed from the rear surface.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-184617, filed Sep. 28, 2018, and No. 2019-146925, filed Aug. 9, 2019, which are hereby incorporated by reference herein in their entirety.

What is claimed is:

1. A liquid ejection head provided with a recording element substrate, the recording element substrate comprising:

an ejection port member including an ejection port that ejects liquid;

an electric wiring layer including a pressure generating element array and electric connection portions, the pressure generating element array including arranged pressure generating elements each pressurizing the liquid for ejection of the liquid, and the electric connection portions being connected to the respective pressure generating elements through electric wirings and supplying power for driving the pressure generating elements to the respective pressure generating elements; and a silicon substrate including the ejection port member and the electric wiring layer on a front surface, wherein the silicon substrate includes a first through hole and a second through hole that penetrate through the silicon substrate, protrude the electric connection portions, and correspond to one line of the pressure generating element array, wherein an opening of the first through hole and an opening of the second through hole are made on a rear surface of the silicon substrate, and the opening of the second through hole is located closest to the opening of the first through hole in a [110] direction of the silicon substrate, wherein the rear surface of the silicon substrate is a (100) surface, and wherein an extension line of a side extending along the [110] direction, out of sides of the opening of the first trough hole and an extension line of a side extending along the [110] direction, out of sides of the opening of the second through hole are displaced from each other in a direction orthogonal to the [110] direction.

2. The liquid ejection head according to claim 1, wherein the silicon substrate has a rectangular outer shape including a side extending along the [110] direction.

3. The liquid ejection head according to claim 2, wherein the first and second through holes are arranged at an end part of the silicon substrate.

4. The liquid ejection head according to claim 1, wherein the opening of each of the first and second through holes has a rectangular shape including a side substantially orthogonal to the [110] direction.

5. The liquid ejection head according to claim 1, wherein the first through hole and the second through hole are arranged to cause a bisector of a side intersecting the [110] direction of the first through hole and a bisector of a side intersecting the [110] direction of the second through hole to overlap with each other, and wherein a length of the side intersecting the [110] direction of the first through hole is larger than a length of the side intersecting the [110] direction of the second through hole.

6. The liquid ejection head according to claim 1, wherein the second through hole is disposed on a bisector of the side extending along the [110] direction of the first through hole.

7. The liquid ejection head according to claim 1, wherein the silicon substrate further includes an ink supply port to supply the liquid to the ejection port, and wherein a third through hole and a fourth through hole each including the electric connection portion on a bottom part are provided at positions asymmetric to the first through hole and the second through hole on the rear surface, with the ink supply port as a symmetry axis.

8. The liquid ejection head according to claim 1, wherein the silicon substrate has a parallelogram outer shape including a side inclined to the [110] direction, and wherein the first and second through holes are arranged along the inclined side.

9. The liquid ejection head according to claim 1, wherein each of the pressure generating elements is a heater for heating the liquid.

10. The liquid ejection head according to claim 1, wherein a plurality of the recording elements is linearly arranged in a longitudinal direction of the liquid ejection head.

11. The liquid ejection head according to claim 1, wherein a plurality of the recording element substrates is arranged in a staggered manner in a longitudinal direction of the liquid ejection head.

12. The liquid ejection head according to claim 1, wherein the liquid ejection head is a page-wide liquid ejection head in which a plurality of the recording element substrates is arranged.

13. The liquid ejection head according to claim 1, further comprising: a cover member that covers side of the liquid ejection head where the ejection port is provided.

14. The liquid ejection head according to claim 1, further comprising:

electric wiring members that are electrically connected to the respective electric connection portions through wires and are configured to supply the power to the respective electric connection portions, wherein an inside of each of the first and second through holes is filled with a sealing member that covers a connection place of the corresponding electric connection portion and the corresponding wire.

* * * * *